US009635943B2

(12) United States Patent
Lawson

(10) Patent No.: US 9,635,943 B2
(45) Date of Patent: May 2, 2017

(54) WALL-PROXIMITY RECLINING MECHANISM WITH CONSISTENT-HEIGHT SEAT

(71) Applicant: L&P PROPERTY MANAGEMENT COMPANY, South Gate, CA (US)

(72) Inventor: Gregory Mark Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 92 days.

(21) Appl. No.: 14/670,192

(22) Filed: Mar. 26, 2015

(65) Prior Publication Data

US 2015/0272329 A1 Oct. 1, 2015

Related U.S. Application Data

(60) Provisional application No. 61/971,845, filed on Mar. 28, 2014.

(51) Int. Cl.

| | |
|---|---|
| ***A47C 1/032*** | (2006.01) |
| ***A47C 7/50*** | (2006.01) |
| ***A47C 1/0355*** | (2013.01) |

(52) U.S. Cl.

CPC ..... *A47C 1/03294* (2013.01); *A47C 1/0355* (2013.01); *A47C 7/506* (2013.01)

(58) Field of Classification Search

CPC ..... A47C 1/03294; A47C 1/0355; A47C 7/50

USPC ..... 297/318, 423.4

See application file for complete search history.

(56) References Cited

U.S. PATENT DOCUMENTS

| | | | | |
|---|---|---|---|---|
| 2,374,848 | A * | 5/1945 | Wohlk | A47C 1/03294 297/318 |
| 3,758,151 | A | 9/1973 | Re | |
| 4,216,992 | A | 8/1980 | Crum | |
| 4,531,778 | A | 7/1985 | Rogers, Jr. | |
| 2012/0193946 | A1* | 8/2012 | Robertson | A47C 1/03294 297/68 |
| 2012/0299363 | A1* | 11/2012 | Crum | A47C 1/0355 297/85 M |

OTHER PUBLICATIONS

International Search Report with Written Opinion dated Jun. 26, 2015 in Application No. PCT/US2015/022987, 7 pages.

* cited by examiner

*Primary Examiner* — Milton Nelson, Jr.

(74) *Attorney, Agent, or Firm* — Shook, Hardy & Bacon L.L.P.

(57) ABSTRACT

A reclining mechanism for use on a chair is disclosed that allows the chair to be placed in close proximity to a wall, and allows the chair back to recline, in part, by moving the seat forwardly, but not upwardly. A chaize option is also disclosed that allows the seating portion of the chaize to move forwardly as the back reclines. In an alternative arrangement, an extendable ottoman is disclosed that is independently operable from the back recline.

12 Claims, 17 Drawing Sheets

WALL-PROXIMITY RECLINING MECHANISM WITH CONSISTENT-HEIGHT SEAT

CROSS-REFERENCE TO RELATED APPLICATIONS

This application claims priority to U.S. Provisional Application Ser. No. 61/971,845, filed Mar. 28, 2014, herein incorporated by reference in its entirety.

STATEMENT REGARDING FEDERALLY SPONSORED RESEARCH OR DEVELOPMENT

Not applicable.

TECHNICAL FIELD

Aspects of this disclosure relate to chair reclining mechanisms. More particularly, this disclosure includes embodiments relating to chair reclining mechanisms that allow a resulting chair to be placed comparably close to a wall, yet have a consistent height seat during recline of the chair. Further embodiments relate to such a chair with a chaise portion, and other embodiments disclose an extendable footrest portion that can be operated independently of the backrest.

BACKGROUND

Chairs having reclining backrests are now well-known and continue to be in popular demand. Certain models of these reclining chairs can now be placed relatively close to a wall. These chairs are commonly known as "wall-proximity chairs" or "zero-wall chairs." In operation, the previous reclining mechanisms of these chairs move the seat upwardly and forwardly as the back reclines. The forward movement of the seat allows the back to recline fully without hitting an adjacent wall. However, it may be desirable in certain chair designs to maintain the seat at a consistent height as the back reclines. Prior chair reclining mechanism design does not allow for the height of the seat to remain at a consistent height as the back reclines, at least in a zero-wall chair. Accordingly, a need exists for a reclining chair mechanism that allows back recline in a zero-wall configuration, and that also does not raise the seat height as the back reclines.

BRIEF SUMMARY

The present disclosure generally relates to a reclining chair mechanism for use on a chair. The mechanism allows the back to recline, while moving the seat forwardly, but not upwardly. This allows the chair to be placed relatively close to a wall and allows a chair design where it is desirable to maintain a consistent seat height. The reclining mechanism uses a pair of tracks and rollers, along with a cooperating linkage to move the seat forwardly as the back reclines.

Accordingly, in one embodiment, a reclining chair mechanism for use on a chair having a frame, a seat, and a backrest is provided. The reclining chair mechanism includes a base plate that is adapted to be coupled to the frame of a chair. The base plate can include one or more roller tracks. The reclining chair mechanism also includes a seat mounting plate that is adapted to be coupled to the seat of the chair. In addition, the reclining chair mechanism includes an elongated roller link coupled to the seat mounting plate and to front and rear rollers. The front and rear rollers are adapted to roll within the one or more roller tracks of the base plate. Further, the reclining chair mechanism includes a backrest linkage coupled to the base plate and to the seat mounting plate. In this embodiment, the base plate, the seat mounting plate, the elongated roller link, and the backrest linkage are adapted to cooperatively shift a backrest of the chair from an upright position to a reclined position while the seat of the chair maintains a substantially consistent height relative to the base plate.

In another embodiment, a reclining chair mechanism for use on a chair having a frame, a seat, and a backrest is provided, which includes a base plate that is adapted to be coupled to the frame of a chair. The base plate can include one or more roller tracks. The reclining mechanism further includes a seat mounting plate that is adapted to be coupled to the seat of the chair. In addition, the reclining chair mechanism includes an elongated roller link coupled to the seat mounting plate and to front and rear rollers. The front and rear rollers are positioned to roll within the one or more roller tracks of the base plate. Additionally, the reclining mechanism includes a backrest linkage coupled between the base plate and the seat mounting plate. The backrest linkage can recline the backrest of the chair as the seat mounting plate translates with respect to the base plate as the front and rear rollers roll within the one or more roller tracks.

In yet another embodiment, a reclining chair is provided. The chair includes a seat, a frame, a backrest, and a reclining mechanism. The reclining mechanism includes a base plate that is adapted to be coupled to the frame and includes one or more roller tracks. The reclining mechanism also includes: a seat mounting plate that is adapted to be coupled to the seat; and an elongated roller link coupled to the seat mounting plate and to front and rear rollers. The front and rear rollers are adapted to roll within the one or more roller tracks of the base plate. The reclining mechanism further includes a backrest linkage coupled to the base plate and to the seat mounting plate. In this embodiment, the base plate, the seat mounting plate, the elongated roller link, and the backrest linkage are adapted to cooperatively shift the backrest from an upright position to a reclined position while the seat maintains a substantially consistent height relative to the base plate.

In further embodiments, a chaise section is included and is supported by an additional roller track and one or more rollers to allow the chaise section to move forwardly, but not upwardly as the back reclines.

In a still further embodiment, an extendable ottoman is provided that can be operated independently of the chair recline. In other words, the back can recline and return to upright without extending the ottoman. Also, the ottoman can be extended and retracted, without moving the seat back.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION

The subject matter of certain aspects is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Figure 1:
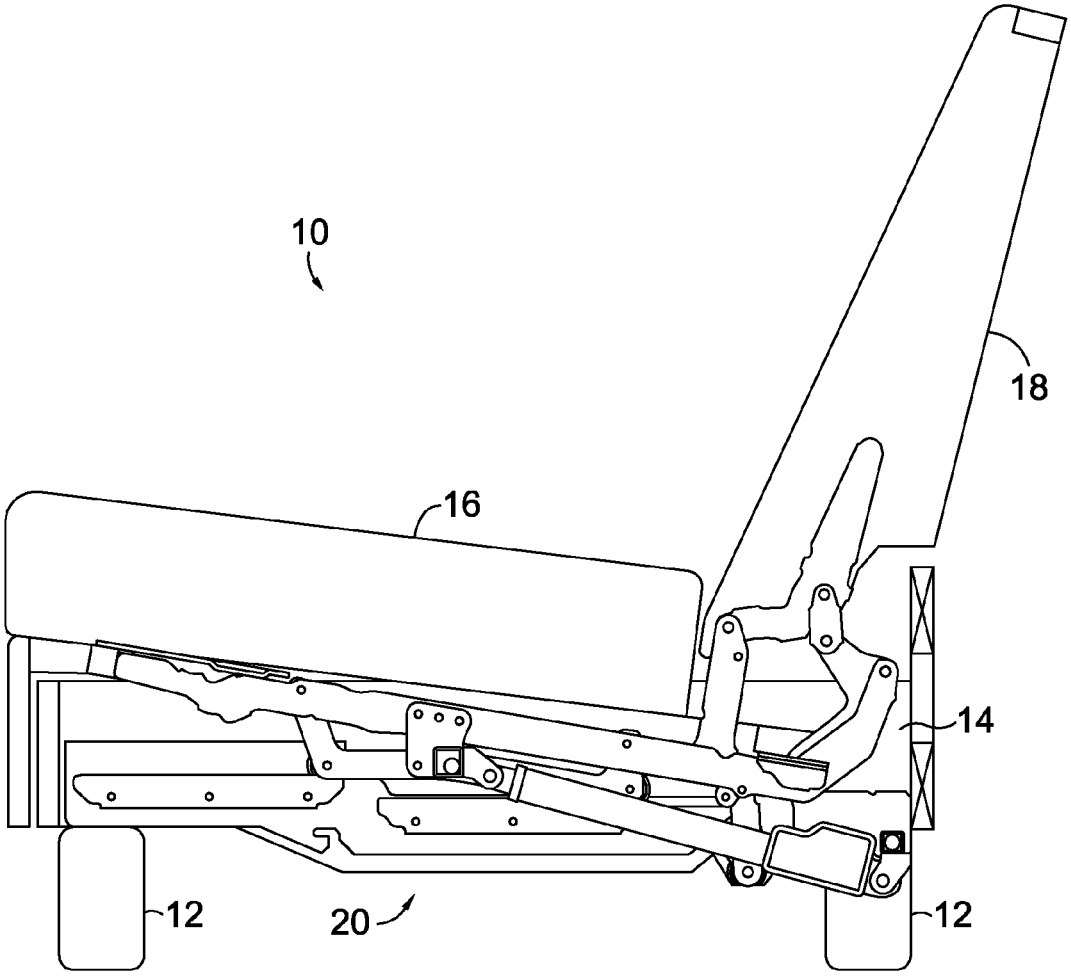
FIG. 1 is a schematic view of an exemplary chair with a reclining mechanism in the closed position.
Figure 2:
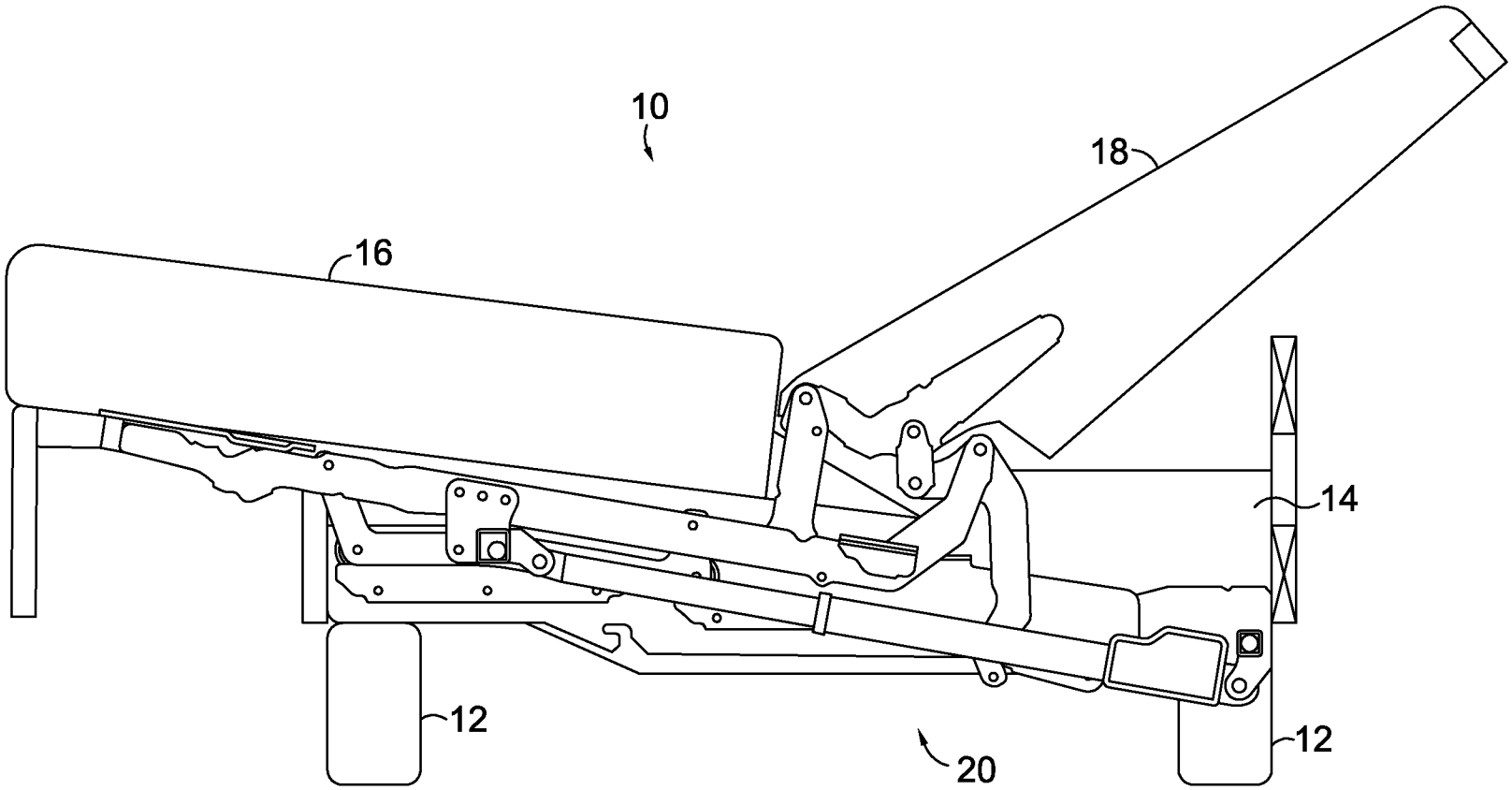
FIG. 2 is a schematic view of an exemplary chair with a reclining mechanism in the reclined position.

As best seen in FIGS. 1 and 2, a chair 10 is shown. Generally, chair 10 is supported by feet 12 above a surface. The feet 12 are connected to a frame 14 that supports a seat 16 and a backrest 18. A reclining mechanism 20 supports the seat 16 and backrest 18 on the frame 14, allowing and controlling movement of the seat 16 and backrest 18 between a closed, upright position shown in FIG. 1, and a reclined position shown in FIG. 2. It should be understood that FIGS. 1 and 2 depict a schematic view of chair 10 with various parts removed and/or with other parts superimposed on other elements, to highlight relevant features of the reclining mechanism 20 and components of chair 10.

The reclining mechanism 20 is more clearly shown in FIGS. 3-7, with parts of the chair 10 removed for clarity. Mechanism 20 is supported on the frame 14 by a pair of base plates 22. In the drawings, only one such base plate is shown. The same will be true for many of the components discussed below. But, other than certain components spanning the sides of the chair 10, a mirror-image component exists on each side of the chair such that a left and a right mechanism are used. For clarity, only one side is shown and discussed below.

It should be understood and appreciated that the components of reclining mechanism 20 discussed herein may be formed from any suitable material known in the furniture-manufacturing industry, such as metal stock (e.g., stamped, formed steel) for brackets, plates, and links, or such as rigid plastic or rubber for rollers. Further, it should be understood and appreciated that the components may be connected together using any techniques or mechanisms known in the furniture-manufacturing industry. For example, components that are rigidly connected may be connected via rivets, bolts, welding, etc. In addition, the shapes of the components described herein may vary, as well as any connection or attachment points between components.

The pivotable couplings between the linkages and/or other components described herein can take a variety of configurations, such as pivot pins, bearings, traditional mounting hardware, rivets, bolt and nut combinations, or any other suitable fasteners which are well-known in the furniture-manufacturing industry. Further, the shapes of the linkages, brackets, and other components may vary, as may the locations of certain pivot and/or connection points. It will be understood that when a linkage is referred to as being pivotably "coupled" to, "connected" to, "interconnected" with, "attached" on, etc., another element (e.g., linkage, bracket, frame, and the like), it is contemplated that the linkage and elements may be in direct contact with each other, or other elements, such as intervening elements, may also be present.

Each base plate 22 has a pair of mounting slots 24 that are used to mount the base plate to the frame 14. The base plates 22 may be further secured to the frame as well. Base plate 22 includes a front roller track 26 and a rear roller track 28. Tracks 26 and 28 can be rigidly secured to the base plates 22 or integral with the base plates 22. Each of tracks 26 and 28 has inwardly extending portions and, preferably, upwardly extending portions. These portions, along with an adjacent portion of base plate 22, form a u-shape section that receives a corresponding roller, as is further discussed below. The tracks 26 and 28 are mounted to, or integrated with, the base plate 22 in such a manner that, when the chair 10 is positioned on a surface, the tracks 26 and 28 extend substantially parallel to the surface, which helps to maintain a consistent seat height as the reclining mechanism 20 adjusts between reclined and upright positions. Although the figures depict two separate roller tracks 26 and 28, it is appreciated that one roller track can be utilized instead of the two separate roller tracks 26 and 28. Such a single roller track can include the combined structure and functionality of the roller tracks 26 and 28. In addition, although the figures depict roller tracks 26 and 28, the reclining mechanism 20 might alternatively include slides, linkages, or some combination thereof that achieve the same consistent-height adjustment as roller tracks 26 and 28.

Figure 6:
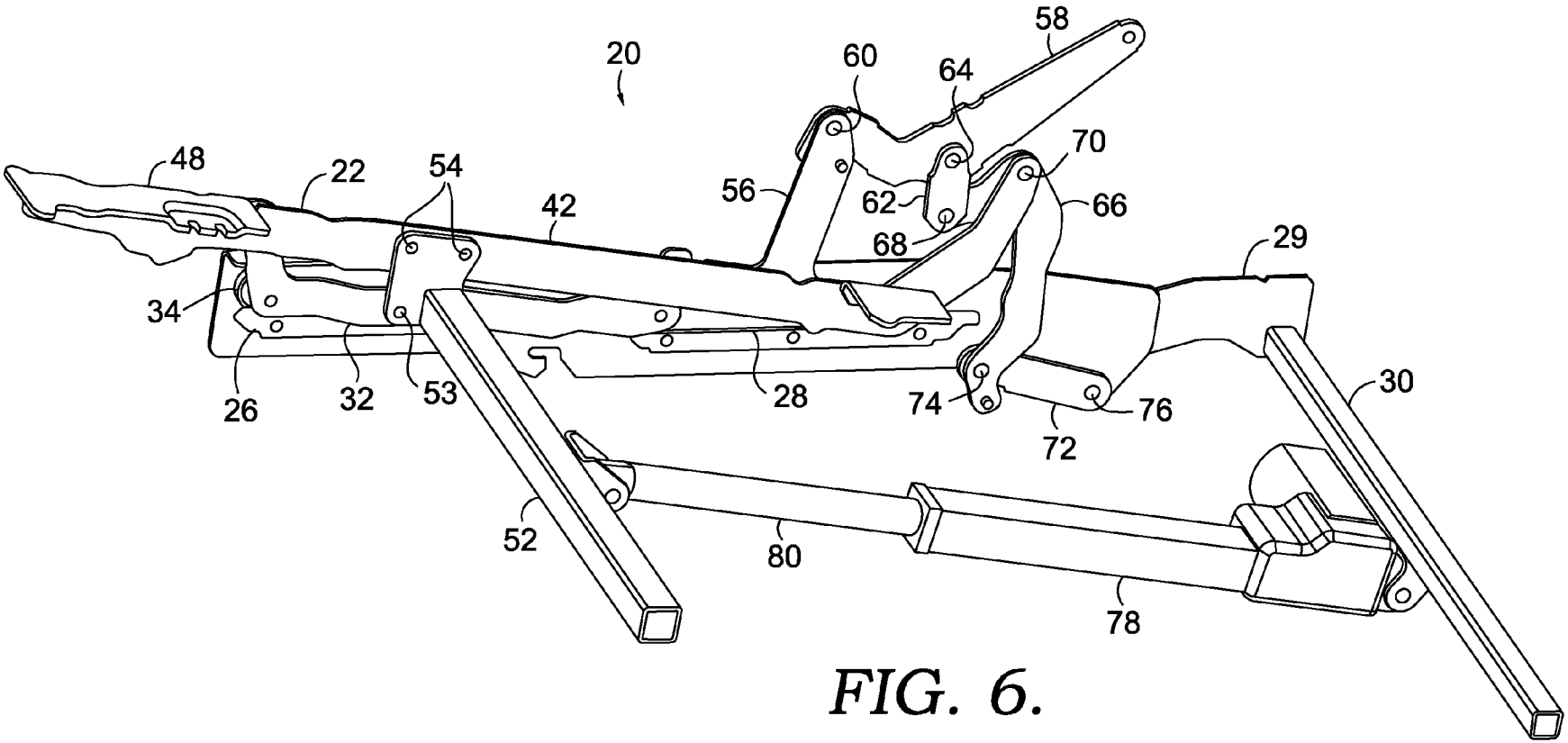
FIG. 6 is a view similar to FIG. 5 but showing the reclining mechanism in the reclined position.

The base plates 22 are coupled to one another via motor tube brackets 29 and a rear cross tube 30 (FIG. 6). Particularly, at each end, the rear cross tube 30 is fixedly coupled to, or integral with, a motor tube bracket 29, which is fixedly coupled to a base plate 22. In this configuration, cross tube 30 extends from one side of the chair 10 to the other and is coupled to each base plate 22 via a motor tube bracket 29.

Figure 3:
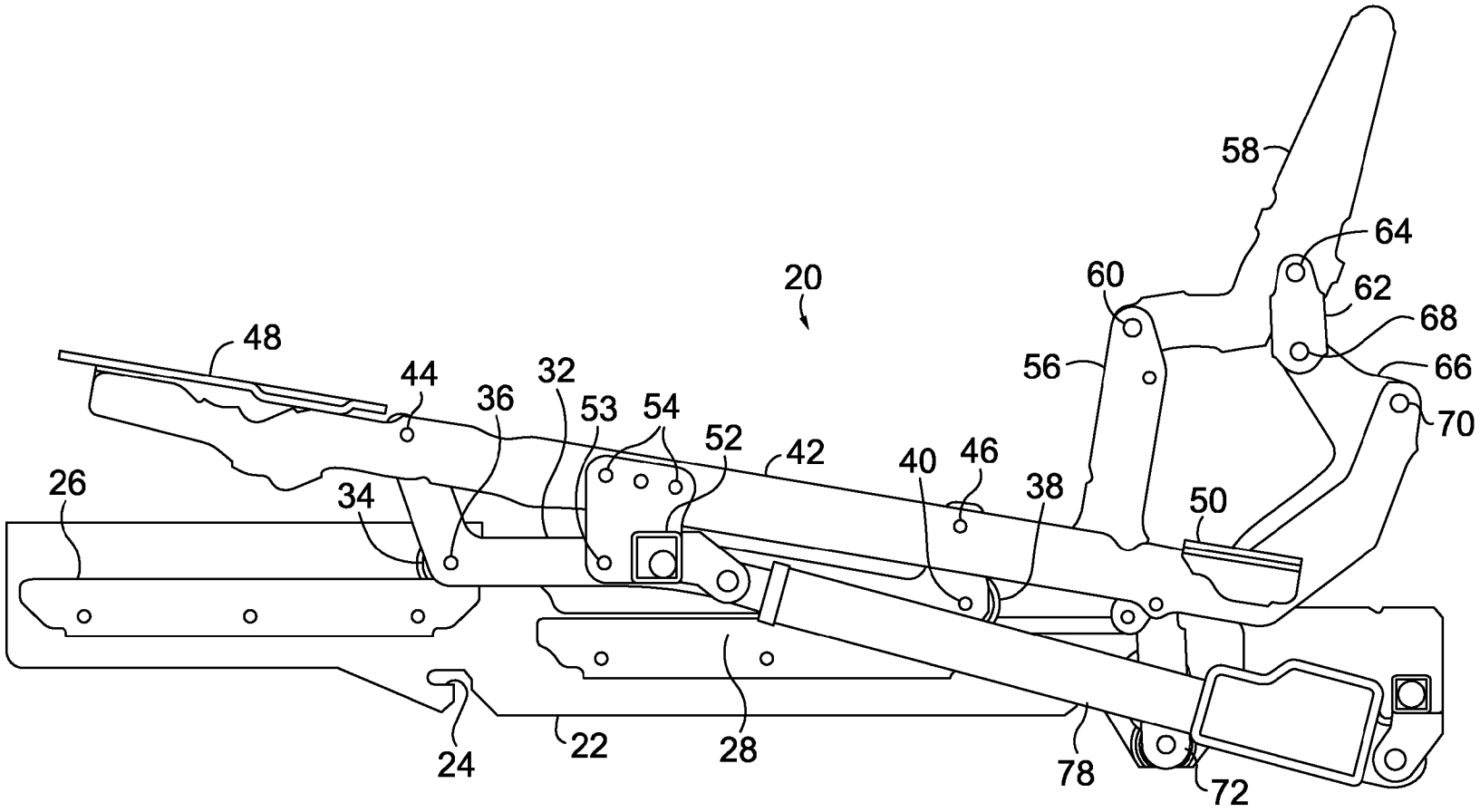
FIG. 3 is a side view of an exemplary chair reclining mechanism, shown in the closed position.
Figure 4:
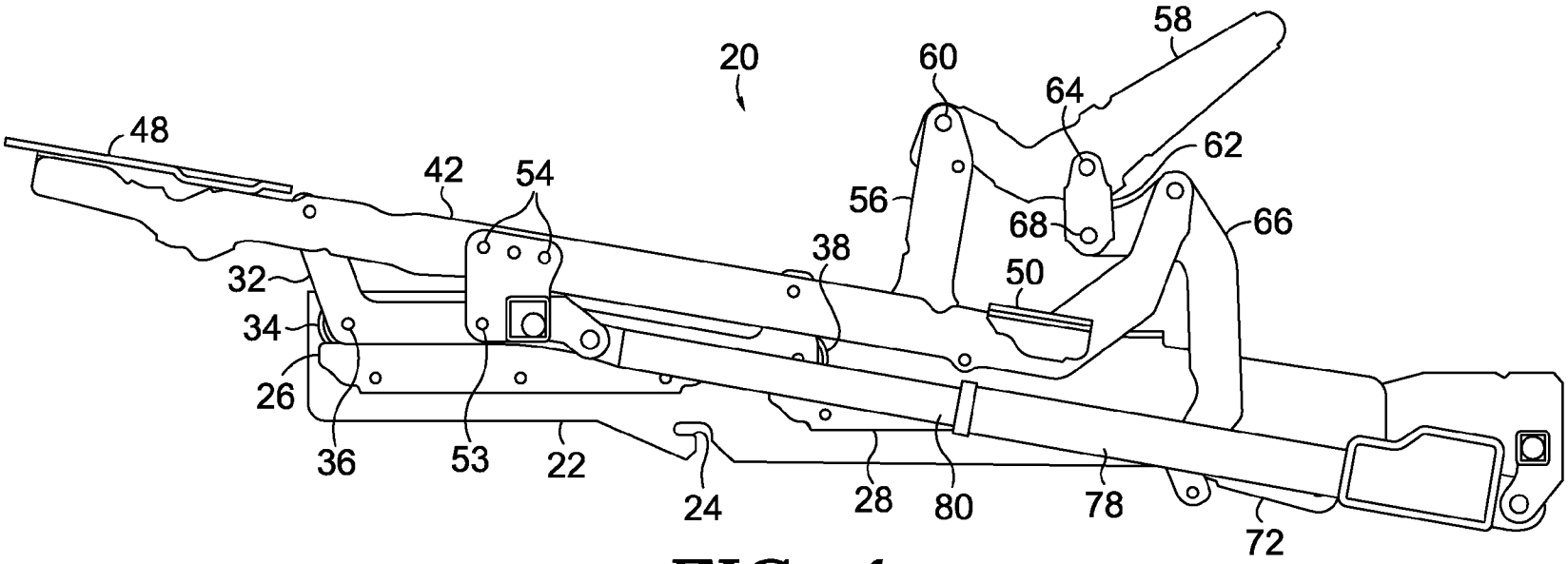
FIG. 4 is a view similar to FIG. 3 but showing the reclined position.
Figure 5:
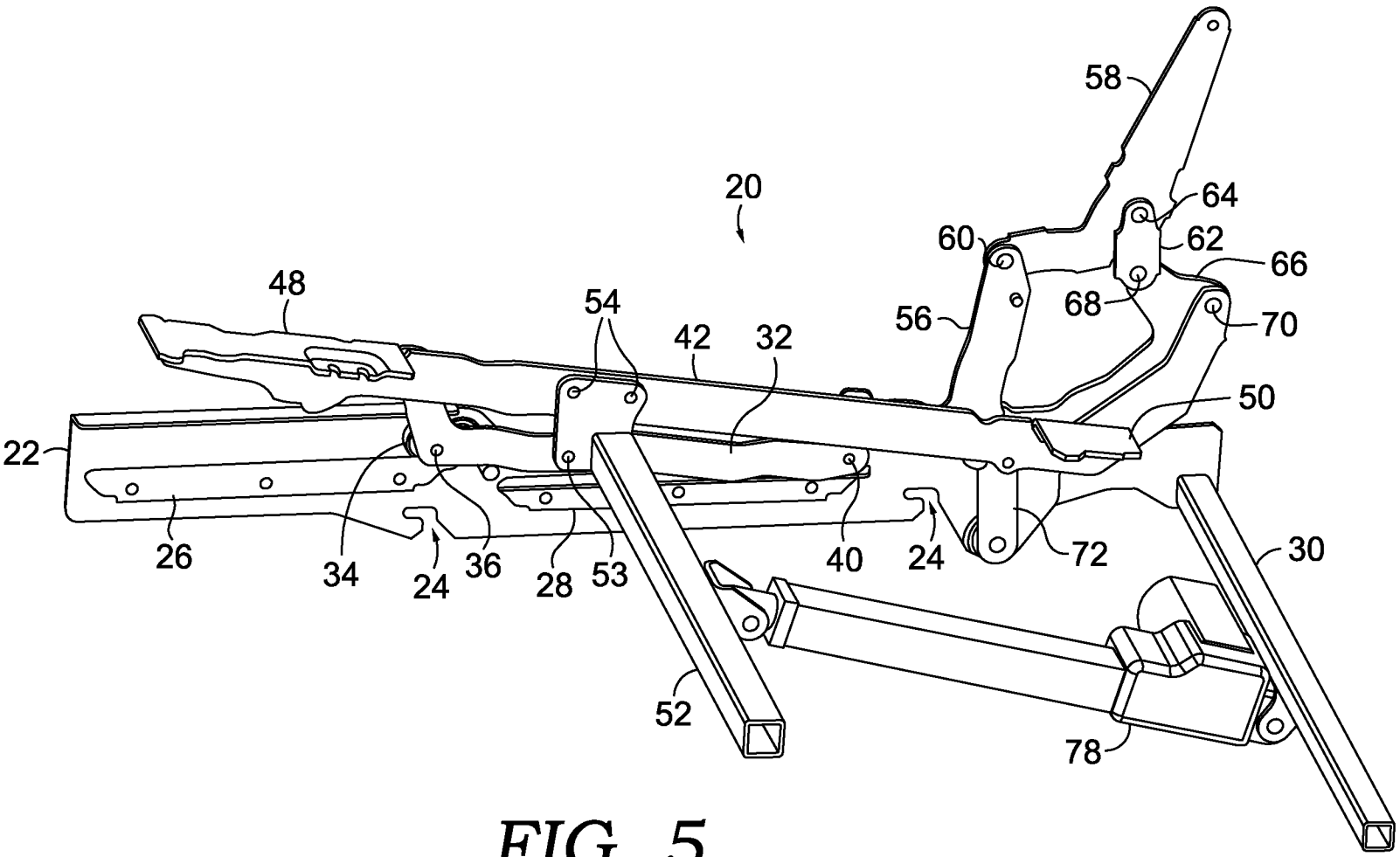
FIG. 5 is an isometric view showing one side of the reclining mechanism in the closed position.

As best seen in FIGS. 3 and 5, mechanism 20 includes an elongated roller link 32. A front roller 34 is coupled to the front end of roller link 32 at axle 36. Axle 36 allows the front roller 34 to rotate with respect to roller link 32. Similarly, a rear roller 38 is coupled to the rear end of roller link 32 at axle 40. Axle 40 allows the rear roller 38 to rotate with respect to roller link 32. Roller link 32 has an upwardly extending mounting section at both the front and rear ends. These mounting sections are used to rigidly couple roller link 32 to a seat mounting plate 42 at connection points 44 and 46. Alternatively, the roller link 32 can be integral with the seat mounting plate 42. The seat mounting plate 42 includes a laterally extending front seat plate 48 and a laterally extending rear seat plate 50. Seat plates 48 and 50 are used to couple seat 16 to the reclining mechanism 20. The seat mounting plates 42 positioned on each side of chair 10 are coupled to one another with a front cross tube 52 (FIG. 5). Front cross tube 52 extends from one side of the chair 10 to the other and is rigidly secured to a corresponding seat mounting plate 42 at each end at connection points 54. Additionally, front cross tube 52 is secured to roller link 32 at connection point 53.

Figure 7:
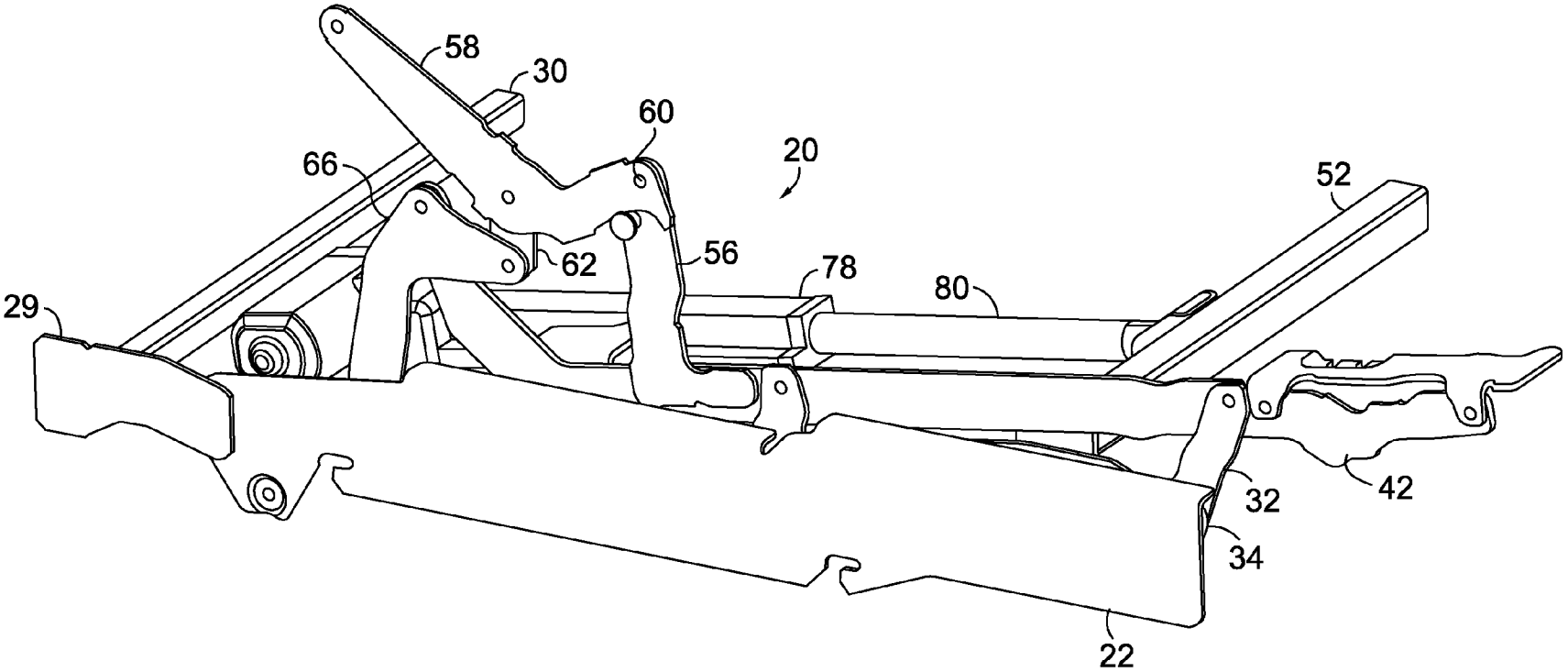
FIG. 7 is a view similar to FIG. 6, showing the view from the opposite side.

A backrest bracket 56 is coupled to the seat mounting plate 42 near the rear end thereof. Preferably, bracket 56 is separately formed and rigidly secured to seat mounting plate 42. However, bracket 56 could be integrated with seat mounting plate 42 to form a one-piece structure as well. As seen in FIG. 7, backrest bracket 56 extends upwardly from the seat mounting plate 42. A backrest link 58 is pivotably coupled to backrest bracket 56 at the upper end thereof, at connection point 60. Backrest link 58 is generally L-shaped and is used to couple the backrest 18 to the reclining mechanism 20. A backrest control link 62 is pivotably coupled to the upstanding section of backrest link 58, near the lower end of the upstanding section at connection point 64. The lower end of backrest control link 62 is pivotably coupled to a rear connector link 66 at connection point 68. Rear connector link 66 is shaped as shown with an upper section and a lower section. Connection point 68 is in the upper section. In the transition area from the upper section to the lower section, the rear connector link 66 is pivotably coupled to a rearward, upstanding portion of seat mounting plate 42 at connection point 70. Rear connector link 66 is also coupled to the base plate 22, via a rear anchor link 72. Particularly, as best seen in FIG. 6, rear connector link 66 is pivotably coupled to an upper end of rear anchor link 72 at connection point 74. The lower end of the rear anchor link 72 is pivotably coupled to the base plate 22 at connection point 76. Backrest bracket 56, backrest link 58, backrest control link 62, rear connector link 66, and rear anchor link 72 work together to couple the seat 16 (through seat mounting plate 42), the backrest 18 (through backrest link 58) and the frame 14 (through base plate 22).

As can be seen in FIG. 6, a linear actuator/motor 78 extends between and couples together the front cross tube 52 and the rear cross tube 30. Actuator 78 is operable to extend an arm 80 forwardly, which can move the front cross tube 52 forwardly relative to the rear cross tube 30.

To move the chair 10 from the closed, upright position shown in FIG. 5, to the reclined position shown in FIG. 6, the actuator 78 is engaged to extend arm 80. The actuator 78 can be engaged to extend arm 80 using any techniques or mechanisms known in the furniture-manufacturing industry, such as by the use of a control device. As arm 80 extends, the front cross tube 52 moves away from the rear cross tube 30. Because cross tube 52 is coupled to roller link 32 and seat mounting plate 42, both roller link 32 and seat mounting plate 42 are urged forwardly as well. Forward movement of the seat mounting plate 42 is allowed and controlled as rollers 34 and 38 roll along tracks 26 and 28, respectively. In this way, the seat 16 moves forwardly, but not upwardly based partly on the orientation of the tracks 26 and 28.

Further, as arm 80 extends, the backrest 18 reclines as backrest link 58 rotates about connection point 60 to the position shown in FIG. 6. Backrest control link 62, rear connector link 66, and rear anchor link 72 cooperate to cause backrest link 58 to rotate about connection point 60 as arm 80 extends to the position shown in FIG. 6. Particularly, as arm 80 extends, seat mounting plate 42 and backrest bracket 56 are urged forwardly away from the rear cross tube 30. As the upstanding portion of the seat mounting plate 42 is urged forward away from the rear cross tube 30, rear connector link 66 is similarly urged forward by the forward force applied to the connection point 70. As rear connector link 66 is urged forward, rear anchor link 72 is rotated about connection point 76 from an upright position as seen in FIG. 5 to a forward position as depicted in FIG. 6. As seat mounting plate 42 continues to move forward, the forward movement of rear connector link 66 is limited once rear anchor link 72 is in a forward position, thereby causing the rear connector link 66 to rotate about connection point 70, which provides a downward force on the backrest control link 62 at connection point 68. The downward force on the backrest control link 62 at connection point 68 causes backrest link 58 to pivot downward about connection point 60 to the reclined position depicted in FIG. 6.

As described above, backrest 18 is shifted into a reclined position at least partly due to the forward movement of seat mounting plate 42. Reclining mechanism 20, therefore, may allow the chair 10 to be placed in closer proximity to a wall by moving the seat forwardly as the back reclines as compared to mechanisms that merely recline the back. Additionally, reclining mechanism 20 can move the seat forwardly without lifting the seat. Although the figures depict the use of a motor 78 to recline seatback 18, other types of actuators might also be used, such as a gas spring or linkages with a mechanical spring.

Figure 8:
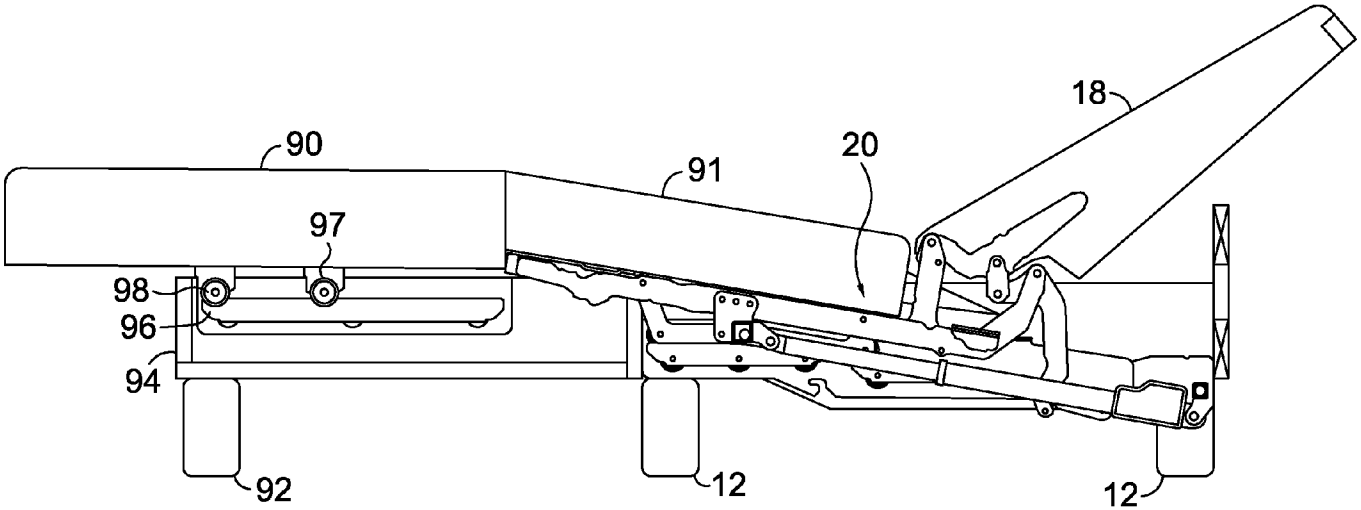
FIG. 8 is a schematic view of an alternative embodiment with a chaise section in the reclined position.
Figure 9:
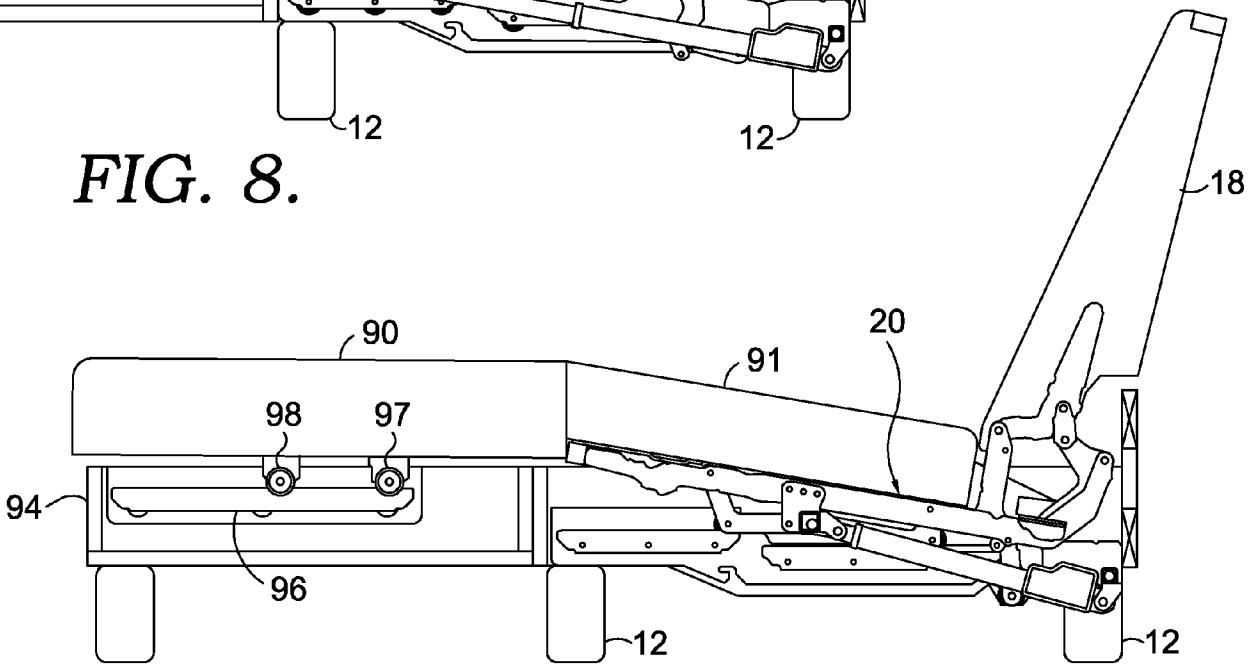
FIG. 9 is a schematic view similar to FIG. 8 in the closed position.

As seen in FIGS. 8 and 9, in an alternative embodiment, seat 16 can be replaced with a chair pad 91 and a chaise pad 90. It should be understood that FIGS. 8 and 9 depict a schematic view of a chair with various parts removed and/or with other parts superimposed on other elements in order to highlight relevant features of this alternative embodiment. Chaise pad 90 and chair pad 91 together are of a length to generally support the entire length of a user's legs, as opposed to only the upper legs of a user. Chaise pad 91 is supported at the most-forward end by additional feet 92 (which may be similar to feet 12). Additionally, a forward frame 94 extends above feet 92 to support the chaise pad 91. To enable chaise pad 91 to move forwardly on frame 94 as the backrest 18 reclines, an additional track 96 is coupled to each side of frame 94. In this embodiment, one or more forward rollers, e.g., forward rollers 97 and 98, are coupled to the lower surface of chaise pad 91. Forward rollers 97 and 98 can support the chaise pad 91 in a rolling condition on track 96. In this way, the reclining mechanism 20 is usable to provide a zero-wall chaise chair, with a seating section that moves forwardly, but not upwardly, as the back reclines. Although the figures depict track 96 and rollers 97 and 98, other mechanisms might also be used to enable the chaise portion to move forwardly. For instance, a caster or roller might be mounted to leg 92, such that the chaise portion rolls forwardly and rearwardly on a surface.

Figure 10:
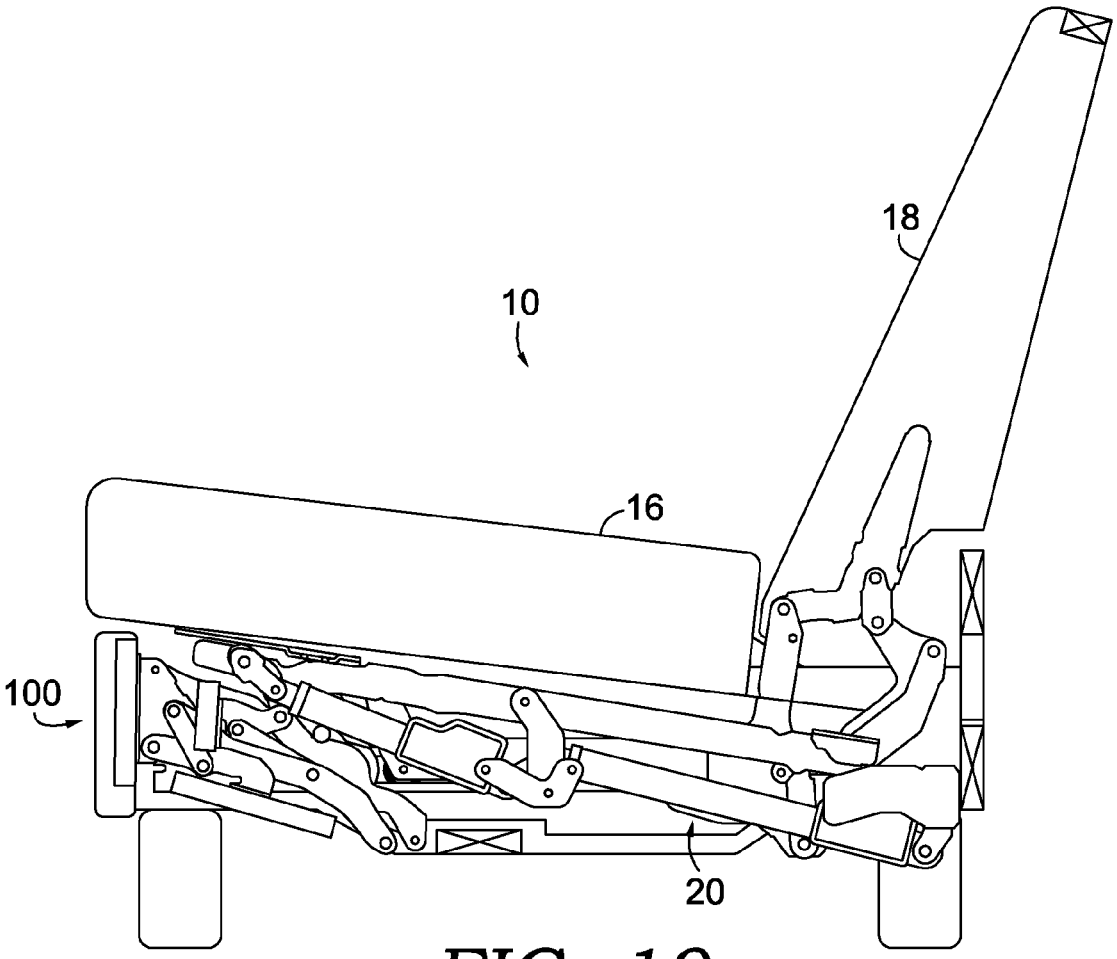
FIG. 10 is a schematic view of an alternative embodiment showing a chair and reclining mechanism including an extendable ottoman, with the chair in the closed position.
Figure 11:
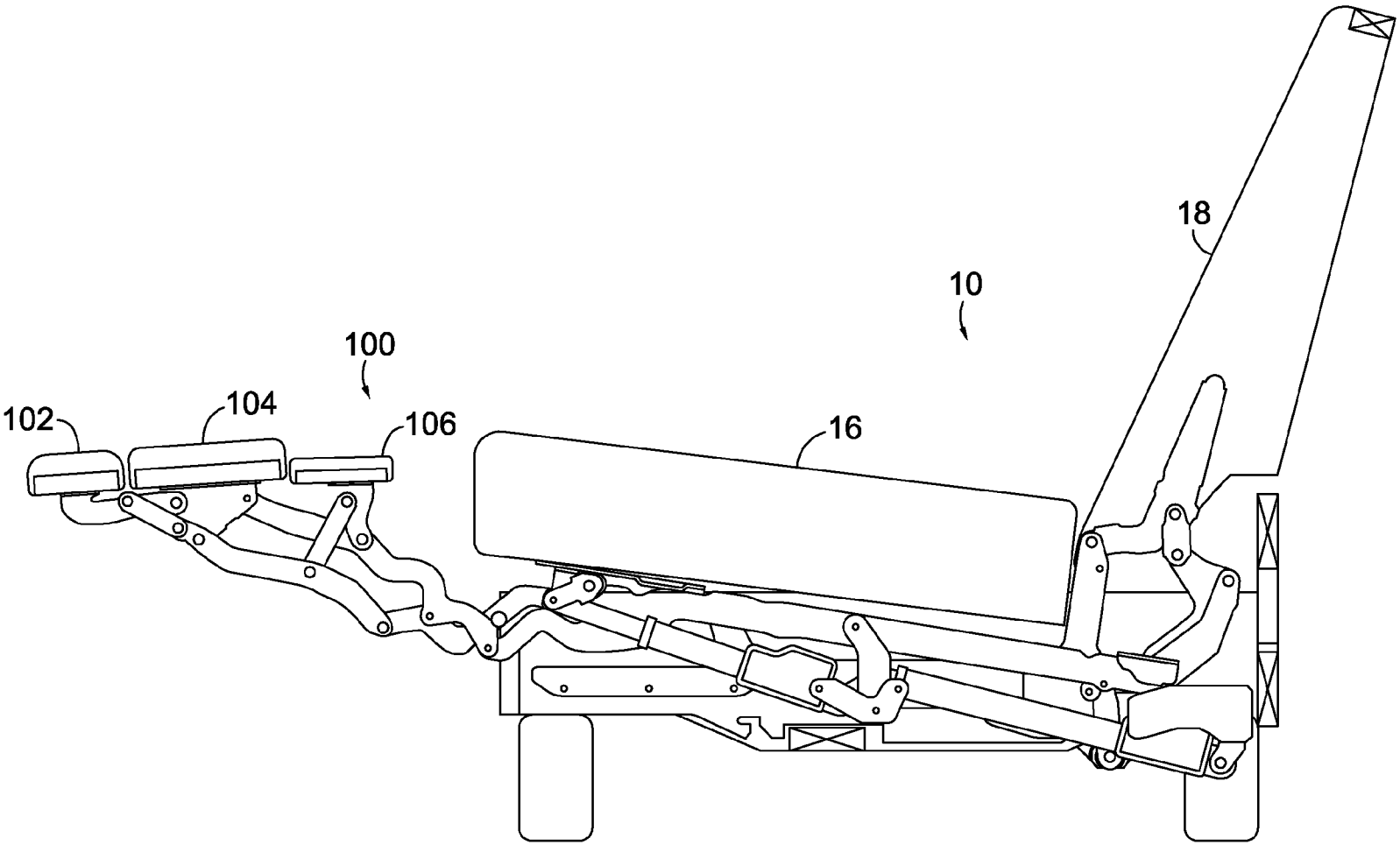
FIG. 11 is a schematic view similar to FIG. 10 showing the ottoman in an extended position.
Figure 12:
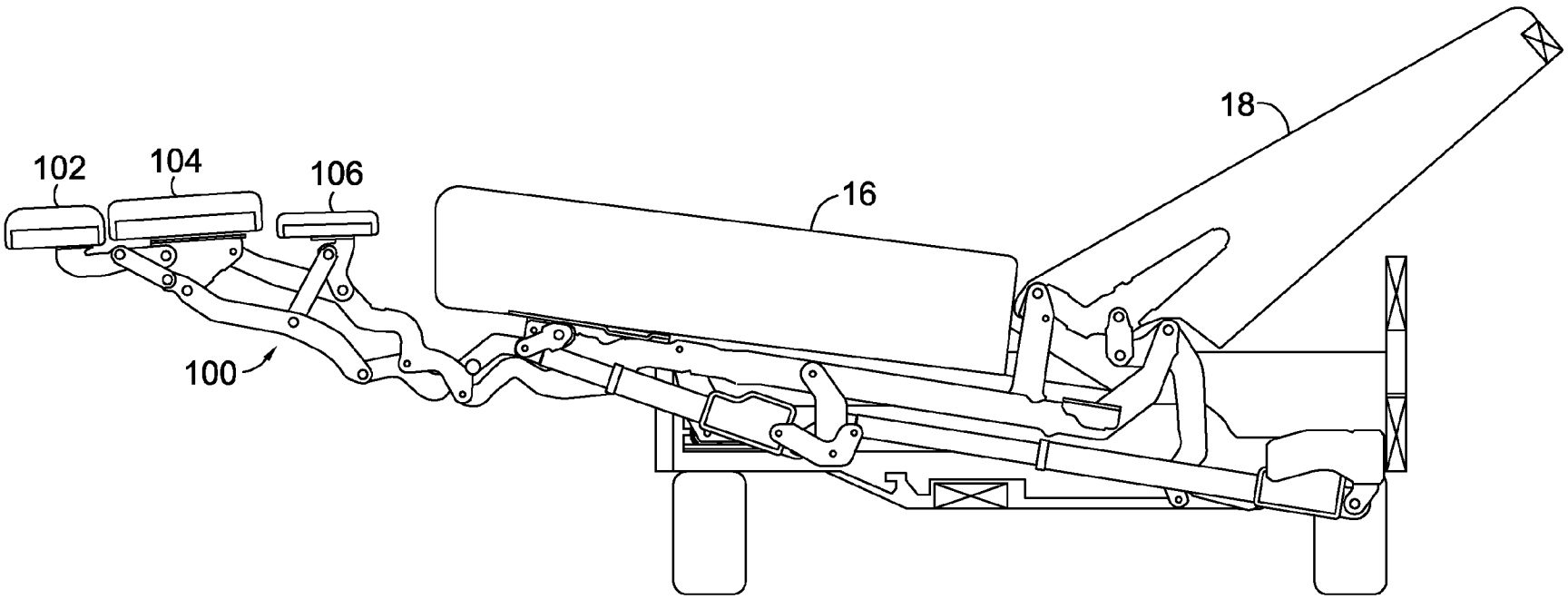
FIG. 12 is a schematic view similar to FIG. 11 showing the chair in the reclined position, with the ottoman in the extended position.

In a further alternative embodiment, as depicted in FIGS. 10-18, chair 10 can be configured to have an extendable ottoman that is operable independently of backrest 18. More specifically, in this alternative embodiment, chair 10 includes extendable ottoman 100 that is operable independent of the position of the backrest 18. For example, ottoman 100 can be either in a closed position, depicted in FIG. 10, or in an extended position, depicted in FIG. 11, while backrest 18 is in an upright position. FIG. 12 further depicts ottoman 100 in an extended position while backrest 18 is in a reclined position. It should be understood that FIGS. 10-12 depict a schematic view of chair 10 with various parts removed and/or with other parts superimposed on other elements in order to highlight relevant features of this alternative embodiment.

Ottoman 100 can include multiple sections, such as the front 102, middle 104, and rear 106 sections shown in FIG. 11. Ottoman 100 is provided by adding to the reclining mechanism 20 described above. The structure and various links of the ottoman 100 may best be understood in viewing FIGS. 13, 14, 17, and 18, with the ottoman 100 in an extended position. As shown in FIGS. 13, 14, 17, and 18, ottoman 100 includes a lower ottoman link 108 that is pivotably attached to seat mounting plate 42 at connection point 110. A drive link 112 is pivotably attached to seat mounting plate 42 forwardly of connection point 110 at connection point 114. The lower ottoman link 108 and the drive link 112 are connected to a series of links that operate to control the extension and support of sections 102, 104, and 106. More specifically, the outer end of lower ottoman link 108 is pivotably coupled to a support link 116 at connection point 118. The support link 116 is also pivotably coupled to drive link 112 at connection point 120. Further along support link 116, a rear ottoman bracket 122 is pivotably coupled to support link 116 at connection point 124. A middle ottoman support bracket 126 is pivotably coupled to support link 116 at the outer-most end of support link 116, at connection point 128. A middle ottoman link 130 is pivotably coupled to the outer-most end of drive link 112 at connection point 132. The opposite end of middle ottoman link 130 is pivotably coupled to middle ottoman bracket 126 at connection point 134. Between the ends of the middle ottoman link 130, a coupling link 136 is pivotably coupled at connection point 138. The opposite end of coupling link 136 is pivotably coupled to rear ottoman bracket 122 at connection point 140. A second coupling link 142 is pivotably coupled to middle ottoman link 130 on one end at connection point 144, and to a front ottoman bracket 146 on the other end at connection point 148. In addition, the front ottoman bracket 146 is pivotably coupled to the middle ottoman bracket 126 at connection point 149. As can be seen, rear ottoman bracket 122 supports rear section 106, middle ottoman bracket 126 supports middle section 104, and front ottoman bracket 146 supports front section 102.

Figure 13:
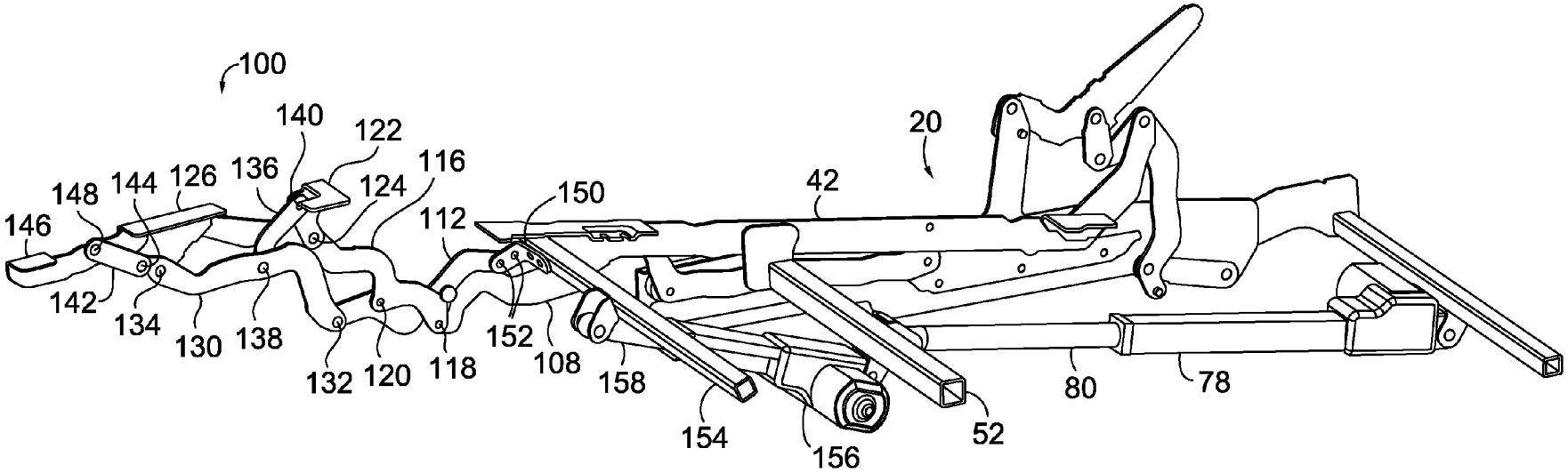
FIG. 13 is an isometric view of the reclining mechanism of FIG. 12.
Figure 14:
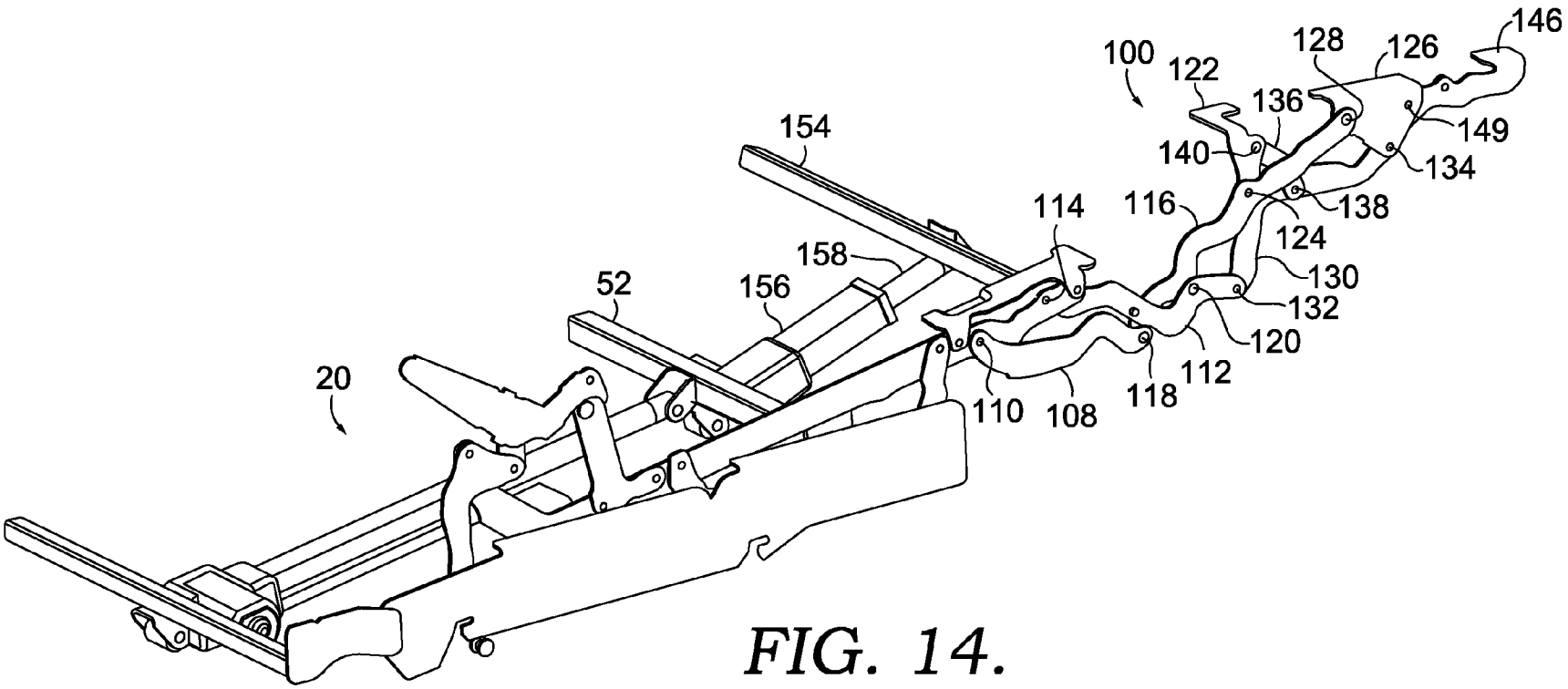
FIG. 14 is a view similar to FIG. 13 showing a view from the opposite side of the reclining mechanism.
Figure 15:
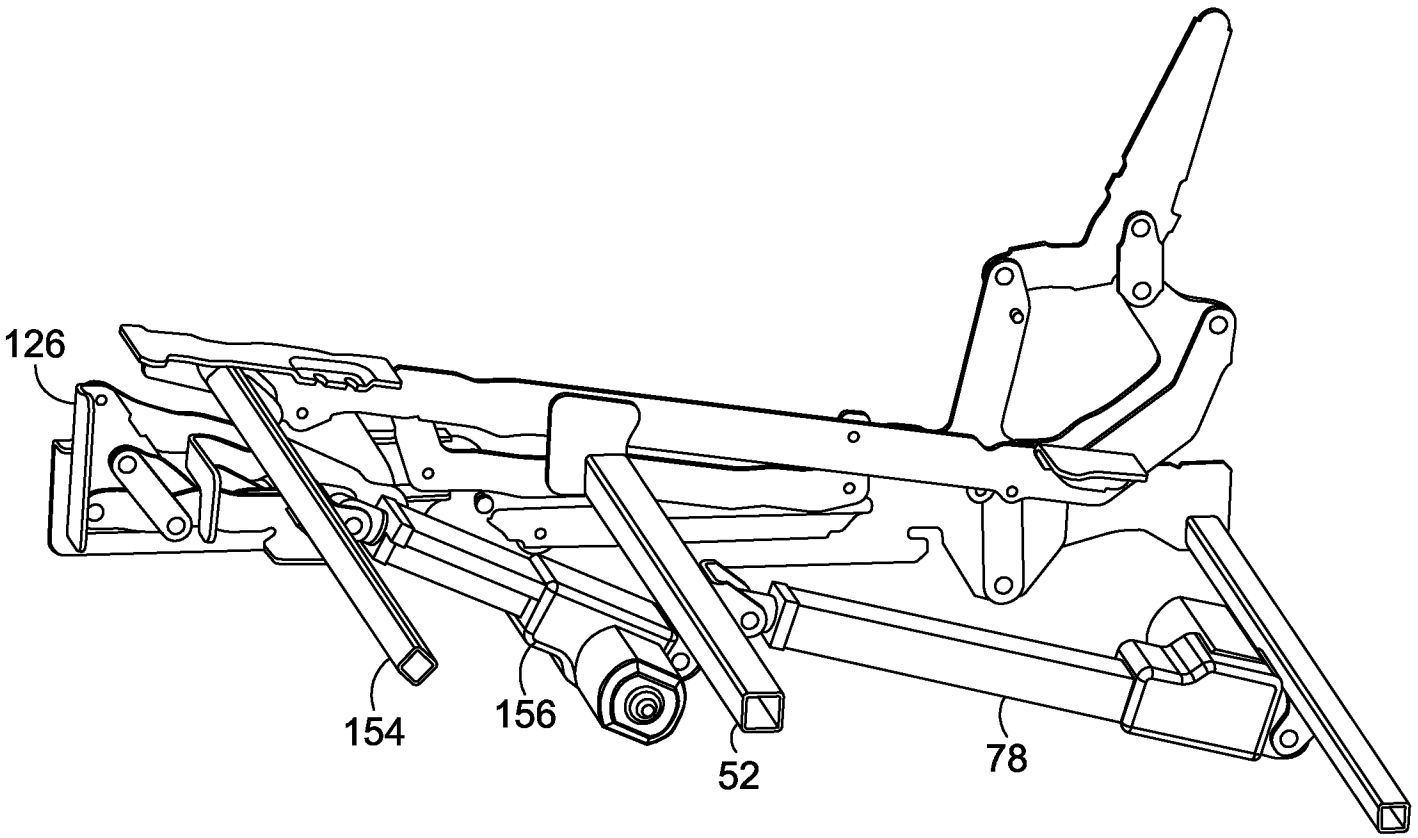
FIG. 15 is an isometric view of the reclining mechanism in the closed position of FIG. 10.
Figure 16:
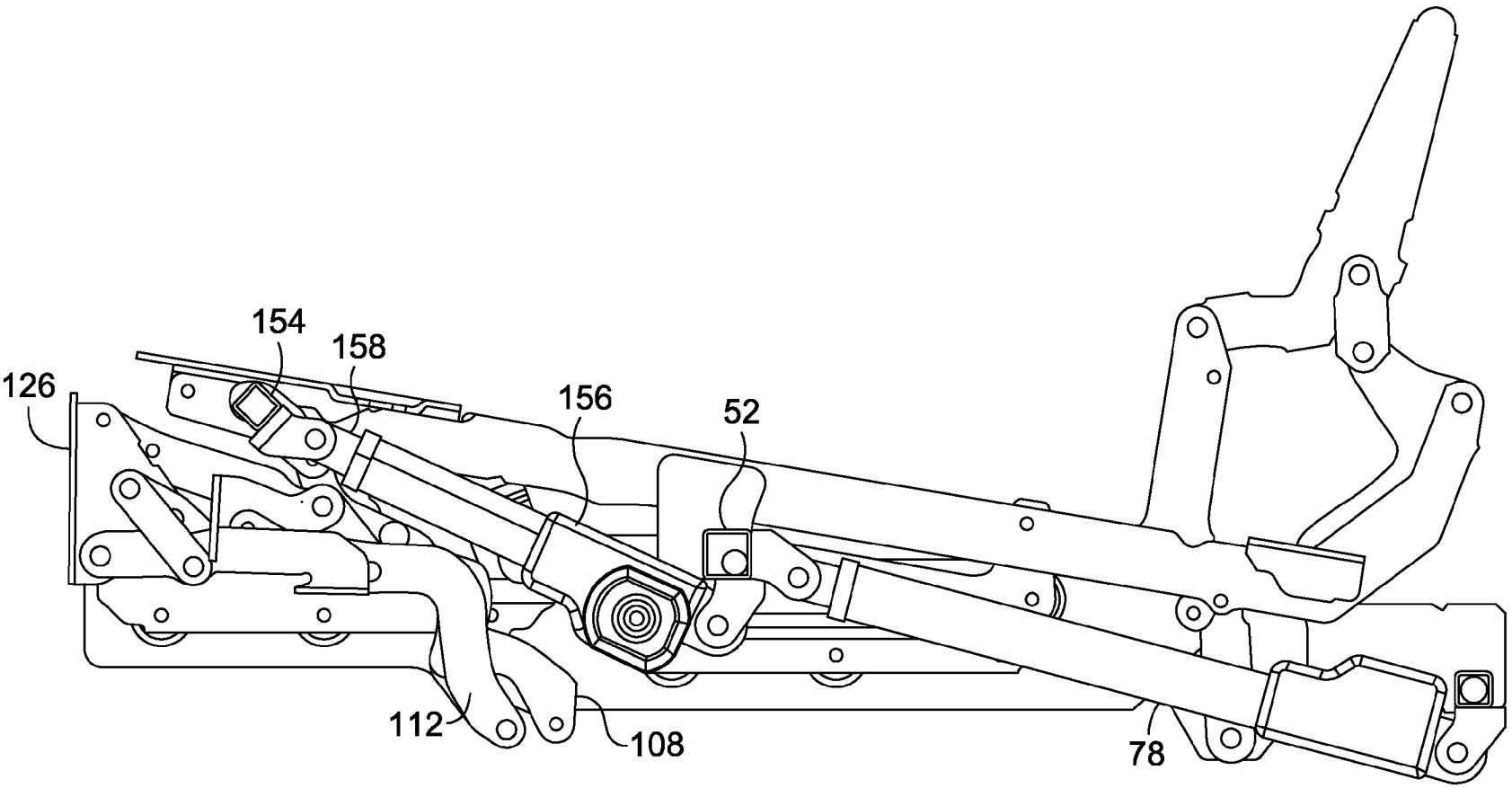
FIG. 16 is a side view of the reclining mechanism of FIG. 15.
Figure 17:
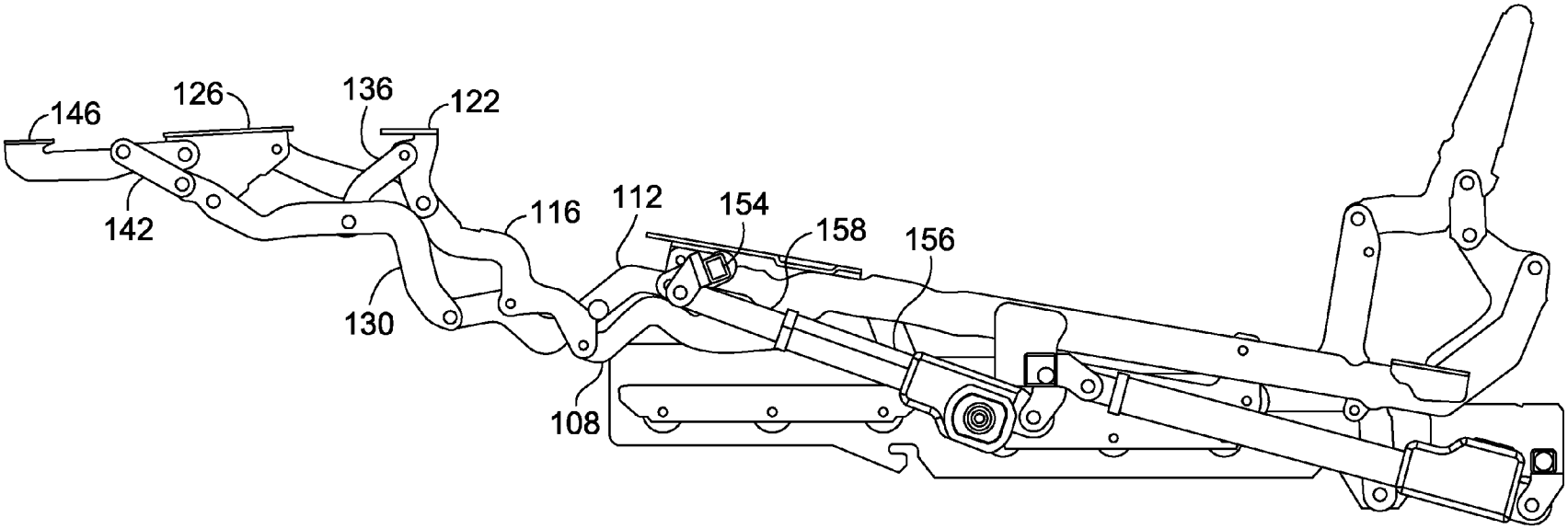
FIG. 17 is a view similar to FIG. 16 showing the ottoman in the extended position.
Figure 18:
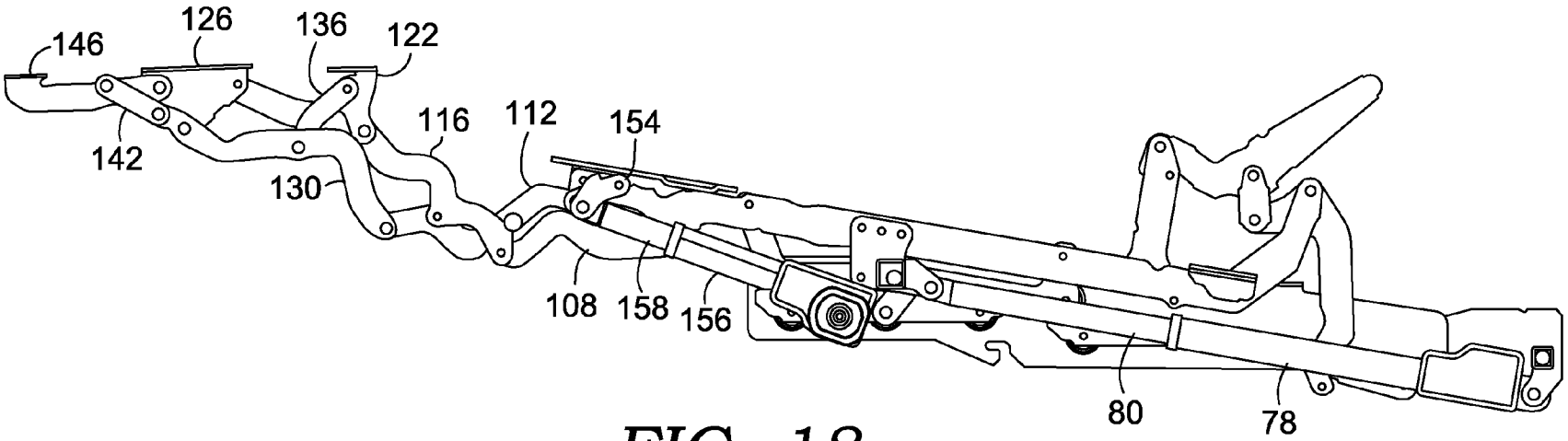
FIG. 18 is a side view of the reclining mechanism of FIG. 13.

To extend and retract the ottoman 100, a drive assembly is attached to the ottoman linkage 100. More specifically, as best seen in FIG. 13, an angle bracket 150 is coupled to drive link 112 at connection points 152. The other end of angle bracket 150 is attached to an ottoman drive tube 154 that extends from one side of the chair to the other. While not shown, the ottoman drive tube 154 is similarly connected to an angle bracket on the side not shown, such that movement of the ottoman drive tube 154 impacts a corresponding ottoman linkage. An ottoman drive actuator 156 is coupled between the front cross tube 52 and the ottoman drive tube 154. The drawings illustrate the actuator 156 as a motor, however, a variety of other actuators might also be used, such as a gas spring.

To extend ottoman 100, an arm 158 of actuator 156 is extended outward away from the front cross tube 52, causing ottoman drive tube 154 to rotate. The actuator 156 can be engaged to extend and/or retract arm 158 using any techniques or mechanisms known in the furniture-manufacturing industry, such as by the use of a control device. The rotational movement of ottoman drive tube 154 is transferred through angle bracket 150 to drive link 112 causing the ottoman linkage to extend as the arm 158 extends, or retract as the arm 158 retracts. Particularly, as angle bracket 150 rotates outward away from the front cross tube 52, drive link 112 is moved outward away from front cross tube 52 rotating about connection point 114. The outward movement of drive link 112 applies a force to connection point 120 causing support link 116 and the lower ottoman link 108 to also move outward. As one skilled in the art can understand, this outward movement of the support link 116, the lower ottoman link 108, and the drive link 112, causes the middle ottoman link 130 and the coupling links 136 and 142 to rotate and extend outward to the extended positions depicted in FIGS. 13, 14, 17, and 18.

To retract ottoman 100 to a closed position, the arm 158 of actuator 156 is retracted towards the front cross tube 52, causing ottoman drive tube 154 to rotate. This rotational movement of ottoman drive tube 154 is transferred through angle bracket 150 to drive link 112, causing the ottoman linkage to retract as arm 158 retracts. Particularly, as angle bracket 150 rotates, drive link 112 will rotate and move toward the front cross tube 52, thereby causing the support link 116 and the lower ottoman link 108 to similarly move toward the front cross tube 52. One skilled in the art would understand that this movement of the drive link 112, the support link 116, and the lower ottoman link 108 causes the retraction of the remaining ottoman links to retract to the positions depicted in FIGS. 15 and 16.

In this alternative embodiment described above with reference to FIGS. 10-18, the addition of the ottoman 100 allows independent movement of the ottoman 100, with respect to the backrest 18. In other words, the ottoman 100 can be extended or retracted without movement of the backrest 18 through the operation of the actuator 156. Similarly, the backrest 18 can be reclined independently of the ottoman 100 through the operation of actuator 78.

From the foregoing, it will be seen that the disclosed reclining mechanism is well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many possible alternative reclining mechanisms may be made without departing from the scope thereof, it is to be understood that all matter herein set forth or shown in the accompanying drawings is to be interpreted as illustrative and not in a limiting sense.

What is claimed is:

1. A reclining chair mechanism for use on a chair having a frame, a seat, and a backrest, comprising:

a base plate adapted to be coupled to a frame of a chair, the base plate including one or more roller tracks;

a seat mounting plate adapted to be coupled to a seat of the chair;

an elongated roller link coupled to the seat mounting plate and to front and rear rollers, the front and rear rollers adapted to roll within the one or more roller tracks of the base plate; and a backrest linkage coupled to the base plate and to the seat mounting plate, wherein the base plate, the seat mounting plate, the elongated roller link, and the backrest linkage are adapted to cooperatively shift a backrest of the chair from an upright position to a reclined position while the seat of the chair maintains a substantially consistent height relative to the base plate, and wherein the seat mounting plate is adapted to translate with respect to the base plate when the front and rear rollers roll within the one or more roller tracks of the base plate.

2. The reclining chair mechanism according to claim 1, wherein the front and rear rollers are adapted to roll within the one or more roller tracks of the base plate as the backrest of the chair is shifted between the upright position and the reclined position.

3. The reclining chair mechanism according to claim 1, wherein the reclining chair mechanism is adapted for use in a chair having an extendable ottoman, wherein the extendable ottoman is adapted to be operated independently of the reclining chair mechanism.

4. The reclining chair mechanism according to claim 1, wherein the front and rear roller tracks are positioned on the base plate such that when the chair is on a surface, the one or more tracks are substantially parallel with the surface.

5. The reclining chair mechanism according to claim 1, wherein the reclining chair mechanism is adapted to allow the backrest of the chair to recline in a zero-wall configuration.

6. The reclining chair mechanism according to claim 1, further comprising a linear actuator adapted to shift the seat mounting plate relative to the base plate so that the backrest of the chair is shifted between the upright position and the reclined position.

7. The reclining chair mechanism according to claim 1, further comprising: a forward track adapted to be coupled to at least a portion of the frame of the chair, the forward track being distinct from the one or more roller tracks; and a forward roller adapted to be coupled to at least a portion of the seat of the chair and adapted to roll within the forward track, the forward roller being distinct from the front and rear rollers.

8. The reclining chair mechanism according to claim 1, wherein the backrest linkage comprises: a backrest bracket coupled to the seat mounting plate; and a backrest link coupled to the backrest bracket, the backrest link adapted to support at least a portion of the backrest of the chair.

9. The reclining chair mechanism according to claim 8, wherein the backrest linkage further comprises a rear connector link pivotably coupled to the seat mounting plate, wherein the rear connector link is adapted to at least partly shift the backrest link between an upright position and a reclined position that correspond with the respective upright and reclined positions of the backrest of the chair.

10. The reclining chair mechanism according to claim 9, wherein the rear connector link is further coupled to the base plate via a rear anchor link.

11. A reclining chair comprising:

a seat;

a frame;

a backrest; and a reclining mechanism, wherein the reclining mechanism comprises:

a base plate adapted to be coupled to the frame, the base plate including one or more roller tracks;

a seat mounting plate adapted to be coupled to the seat;

an elongated roller link coupled to the seat mounting plate and to front and rear rollers, the front and rear rollers adapted to roll within the one or more roller tracks of the base plate; and a backrest linkage coupled to the base plate and to the seat mounting plate, wherein the base plate, the seat mounting plate, the elongated roller link, and the backrest linkage are adapted to cooperatively shift the backrest between an upright position and a reclined position while the seat maintains a substantially consistent height relative to the base plate, and wherein the seat mounting plate is adapted to translate with respect to the base plate when the front and rear rollers roll within the one or more roller tracks of the base plate.

12. The reclining chair according to claim 11, further comprising an extendable ottoman, wherein the extendable ottoman is adapted to be operated independently of the reclining chair mechanism.

* * * * *